US007641076B2

(12) United States Patent
Nishida

(10) Patent No.: US 7,641,076 B2
(45) Date of Patent: Jan. 5, 2010

(54) LIQUID DISPENSING SYSTEM

(76) Inventor: Tamotsu Nishida, 1128 W. McGill St., Covina, CA (US) 91722

( * ) Notice: Subject to any disclaimer, the term of this patent is extended or adjusted under 35 U.S.C. 154(b) by 441 days.

(21) Appl. No.: 11/565,274

(22) Filed: Nov. 30, 2006

(65) Prior Publication Data

US 2007/0072496 A1 Mar. 29, 2007

(51) Int. Cl.
*B67D 5/06* (2006.01)

(52) U.S. Cl. ..... 222/185.1; 222/204; 141/18

(58) Field of Classification Search ..... 222/185.1, 222/204, 207, 416, 632, 633, 318, 376; 62/389; 141/18

See application file for complete search history.

(56) References Cited

U.S. PATENT DOCUMENTS 643,411 A * 2/1900 Kammerer ..... 210/175
690,896 A * 1/1902 Shears ..... 62/317
692,523 A * 2/1902 Kammerer ..... 62/306
3,653,413 A * 4/1972 Sheya ..... 141/1
4,030,634 A 6/1977 Osborn
4,153,181 A 5/1979 Parker et al.
D295,522 S 5/1988 Martin et al.
5,495,725 A 3/1996 Middlemiss
5,638,991 A 6/1997 Todden et al.
5,649,647 A * 7/1997 Kodarar ..... 222/204
6,209,753 B1 4/2001 Ohu
2006/0191284 A1* 8/2006 Fuller ..... 62/389
2006/0266767 A1* 11/2006 Butters ..... 222/67

* cited by examiner

*Primary Examiner*—Kevin P Shaver
*Assistant Examiner*—Daniel R Shearer

(57) ABSTRACT

A liquid dispensing system for dispensing liquid from a container to be consumed includes a base being positionable on a support surface. The base includes a perimeter wall defining an interior space of the base. The interior space receives and stores the liquid to be dispensed. A spigot is coupled to the perimeter wall and in fluid communication with the interior space. A container is positioned on the base. The container contains the liquid to be supplied to the interior space of the base. A pump assembly is coupled to the base and in fluid communication with the container and the interior space of the base. The pump assembly is actuated to transfer liquid from the container and into the interior space of the base.

10 Claims, 8 Drawing Sheets

LIQUID DISPENSING SYSTEM

BACKGROUND OF THE INVENTION

1. Field of the Invention

The present invention relates to bottled water transfer devices and more particularly pertains to a new bottled water transfer device for dispensing liquid from a container so that the liquid may be consumed.

2. Description of the Prior Art

The use of bottled water transfer devices is known in the prior art. The prior art commonly teaches the use of electrical pumps to drain water from the container for dispensing.

While these devices fulfill their respective, particular objectives and requirements, the need remains for a system that has certain improved features using a siphoning effect to draw liquid from a container. Additionally, the system requires no electricity to operate and thus makes the system versatile in its placement.

SUMMARY OF THE INVENTION

The present invention meets the needs presented above by generally comprising a base being positionable on a support surface. The base includes a perimeter wall defining an interior space of the base. The interior space receives and stores the liquid to be dispensed. A spigot is coupled to the perimeter wall and in fluid communication with the interior space. A container is positioned on the base. The container contains the liquid to be supplied to the interior space of the base. A pump assembly is coupled to the base and in fluid communication with the container and the interior space of the base. The pump assembly is actuated to transfer liquid from the container and into the interior space of the base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
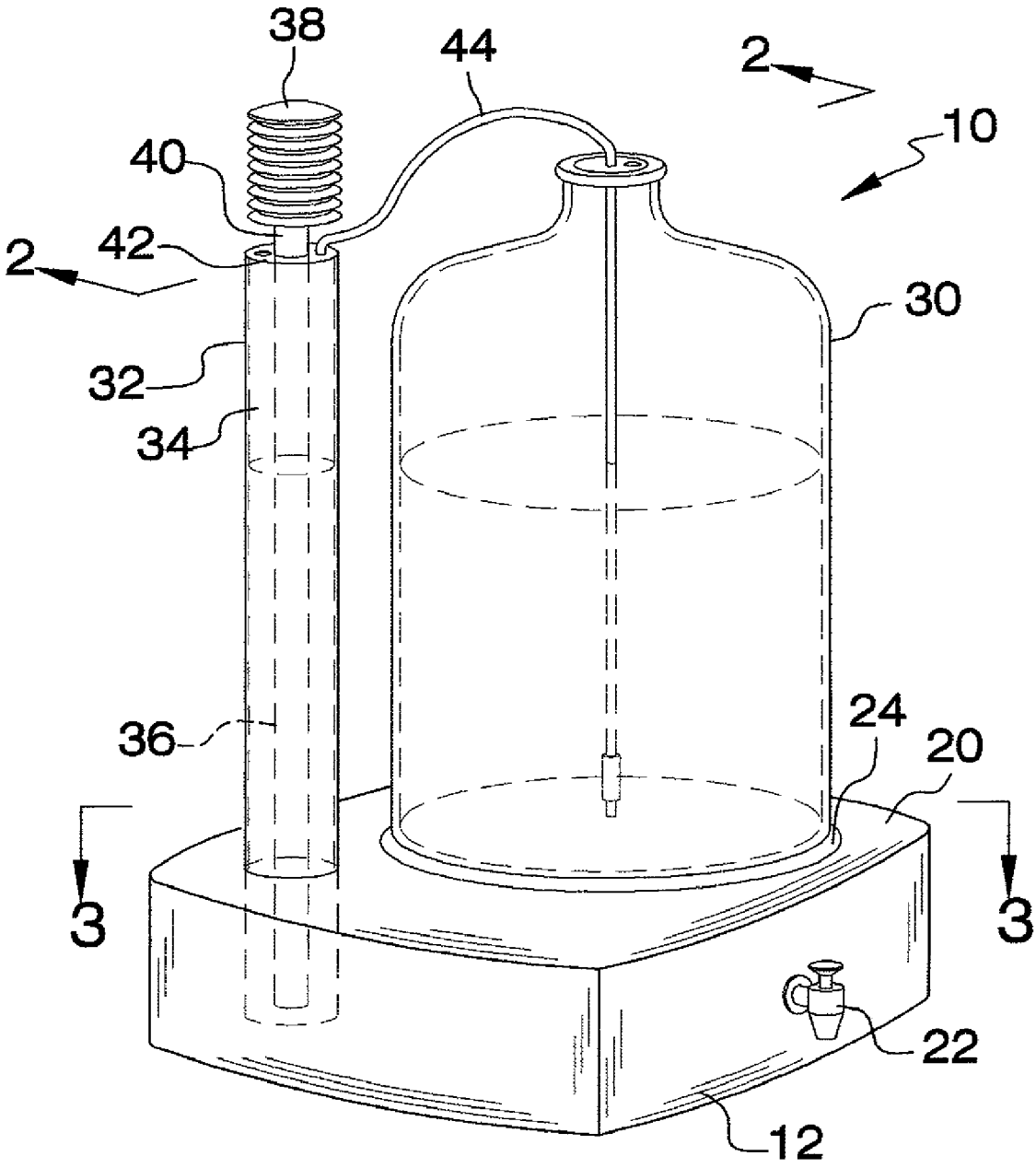
FIG. 1 is a perspective view of a liquid dispensing system according to the present invention.
Figure 2:
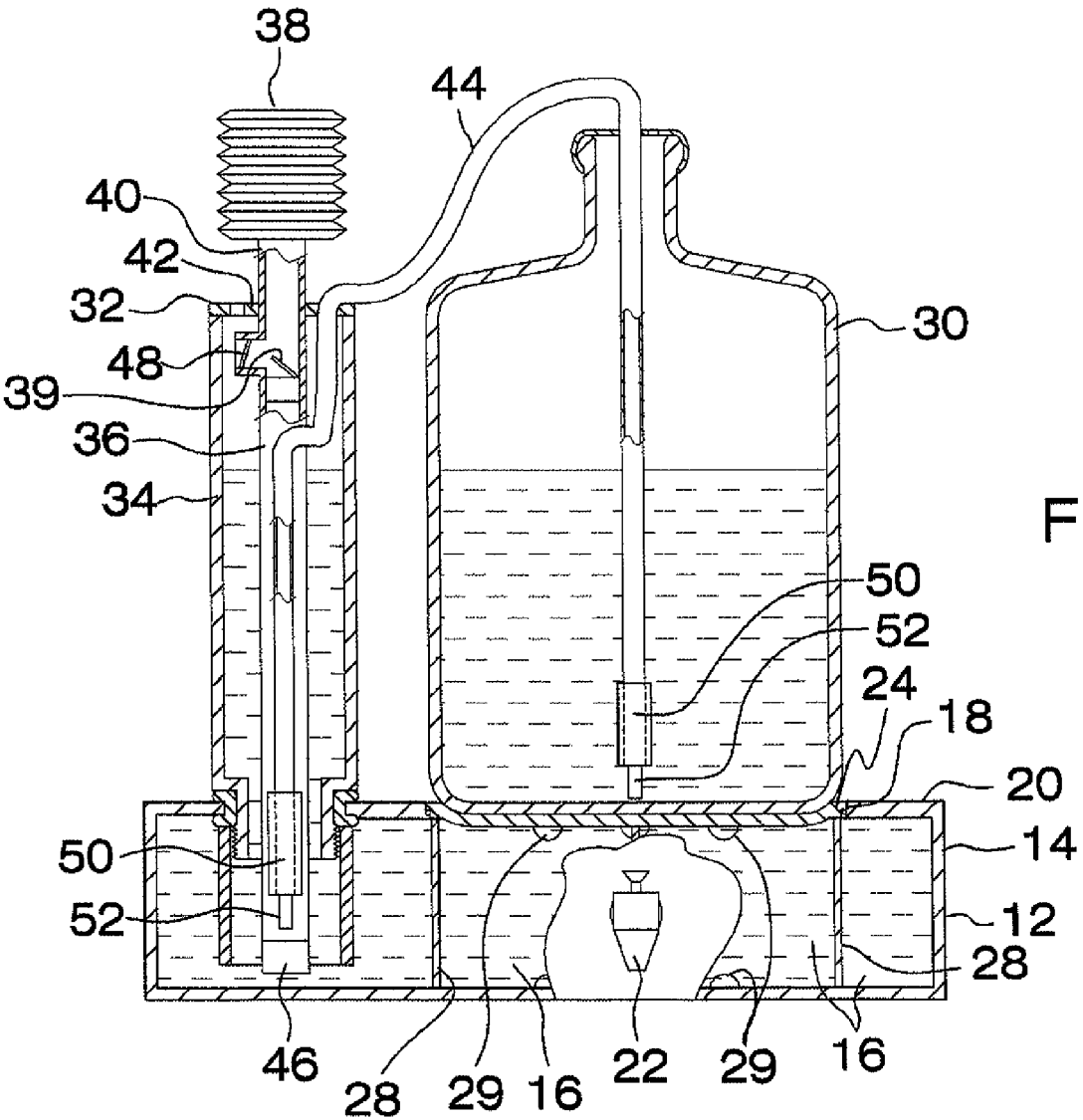
FIG. 2 is a cross-sectional view of the present invention taken along line 2-2 of FIG. 1.
Figure 3:
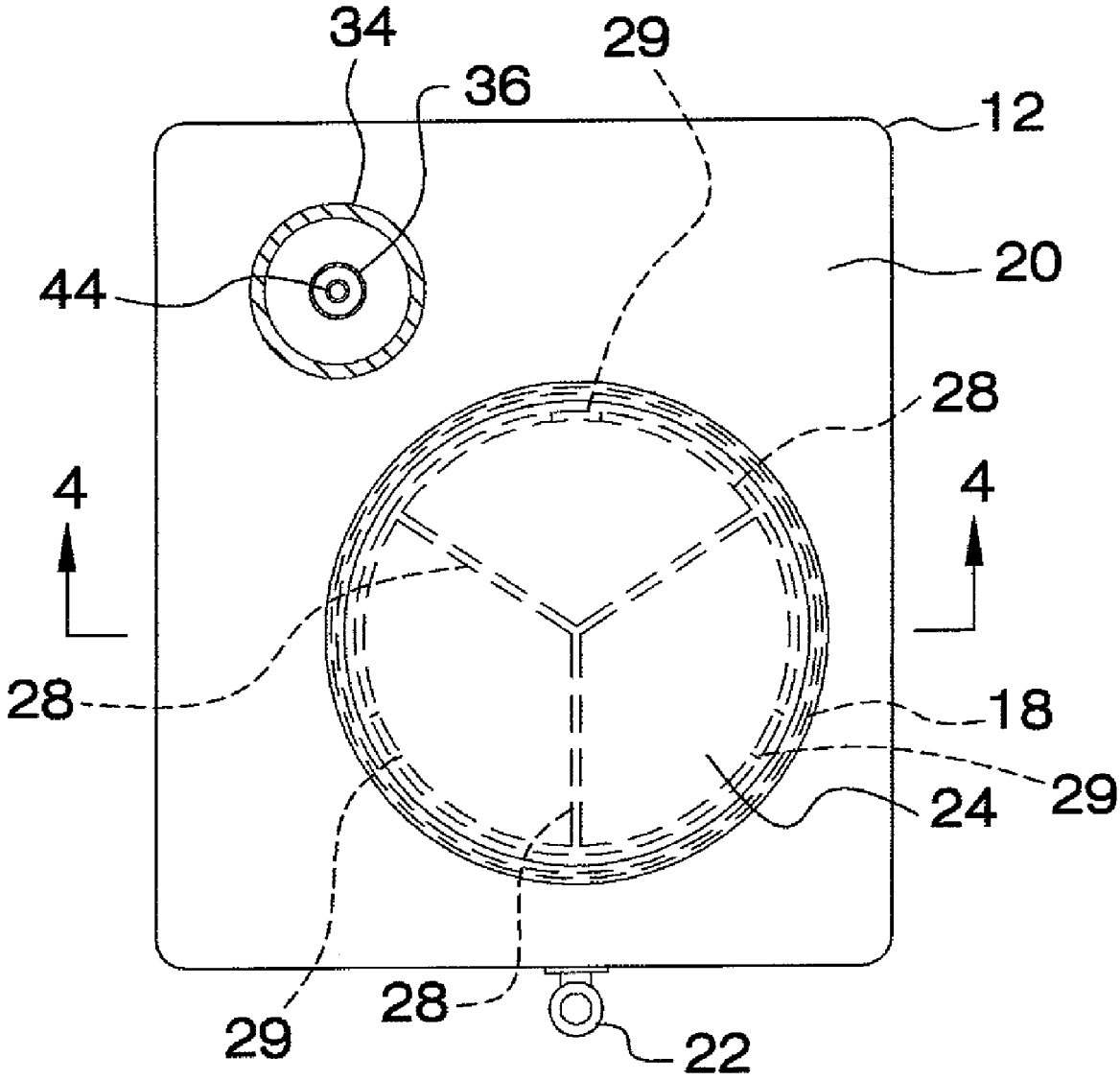
FIG. 3 is a cross-sectional view of the present invention taken along line 3-3 of FIG. 1.
Figure 4:
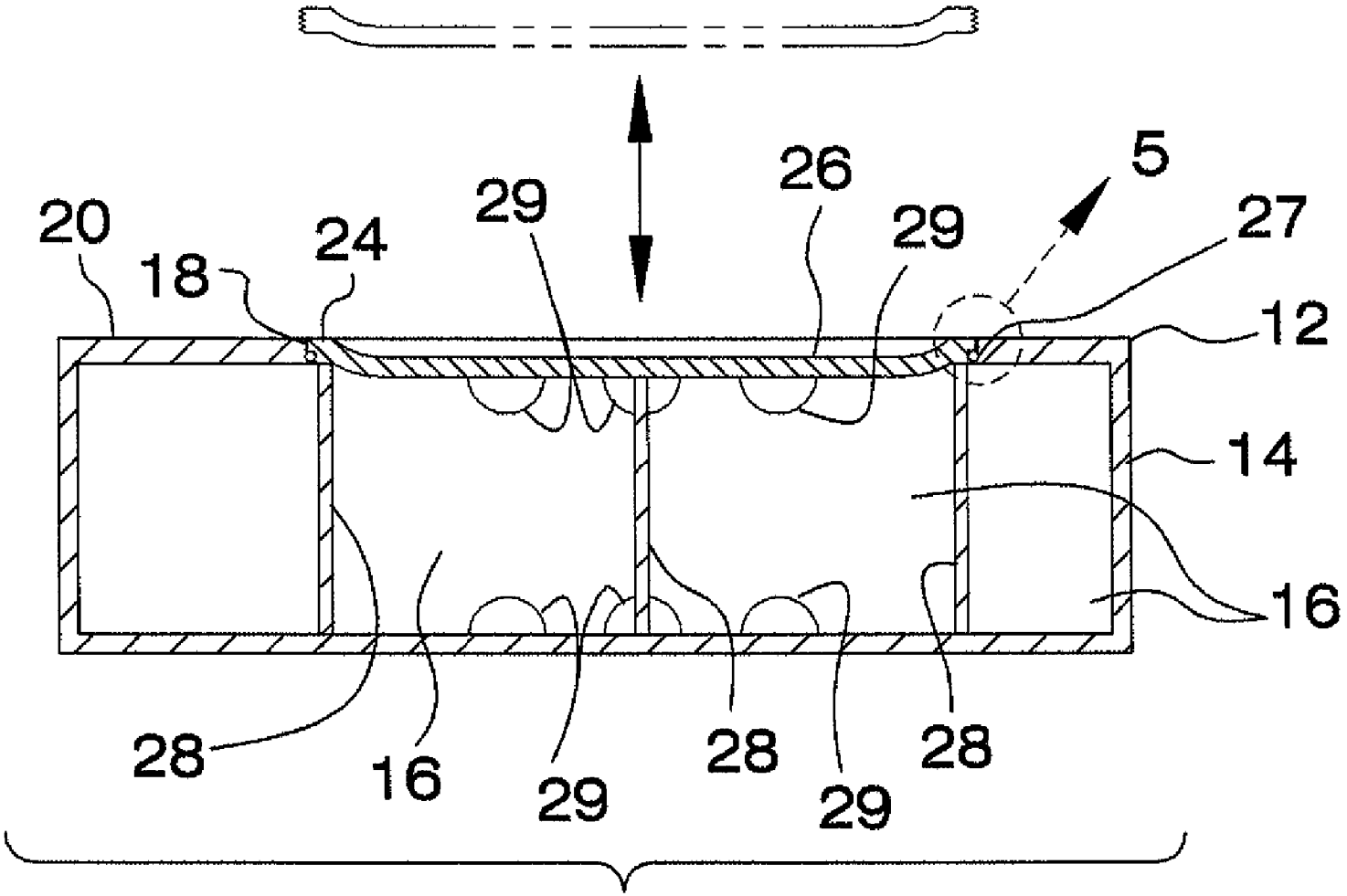
FIG. 4 is a cross-sectional view of the present invention taken along line 4-4 of FIG. 3.
Figure 5:
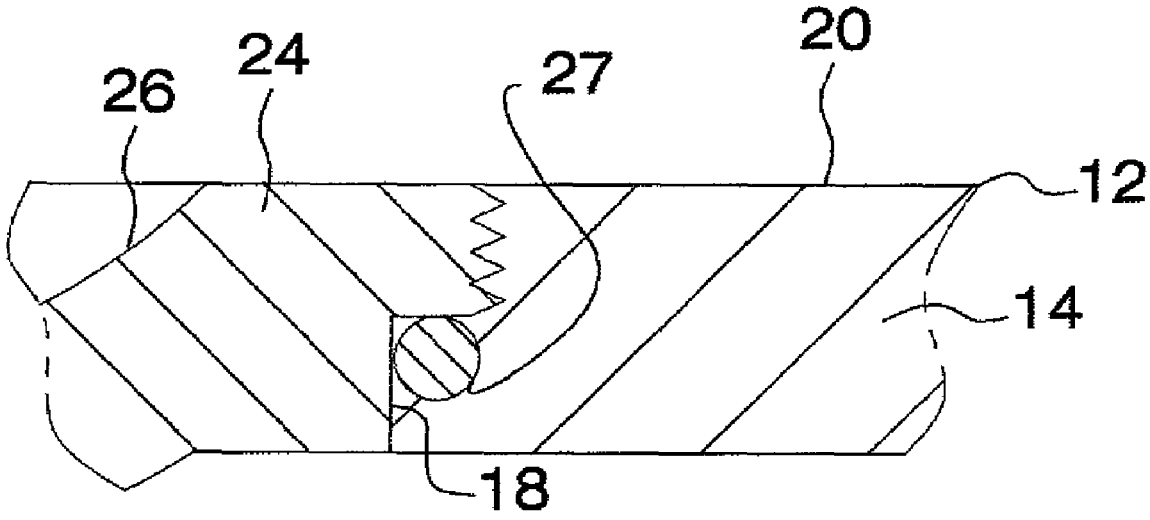
FIG. 5 is an enlarged view of the present invention of the area designated 5 in FIG. 4.
Figure 6:
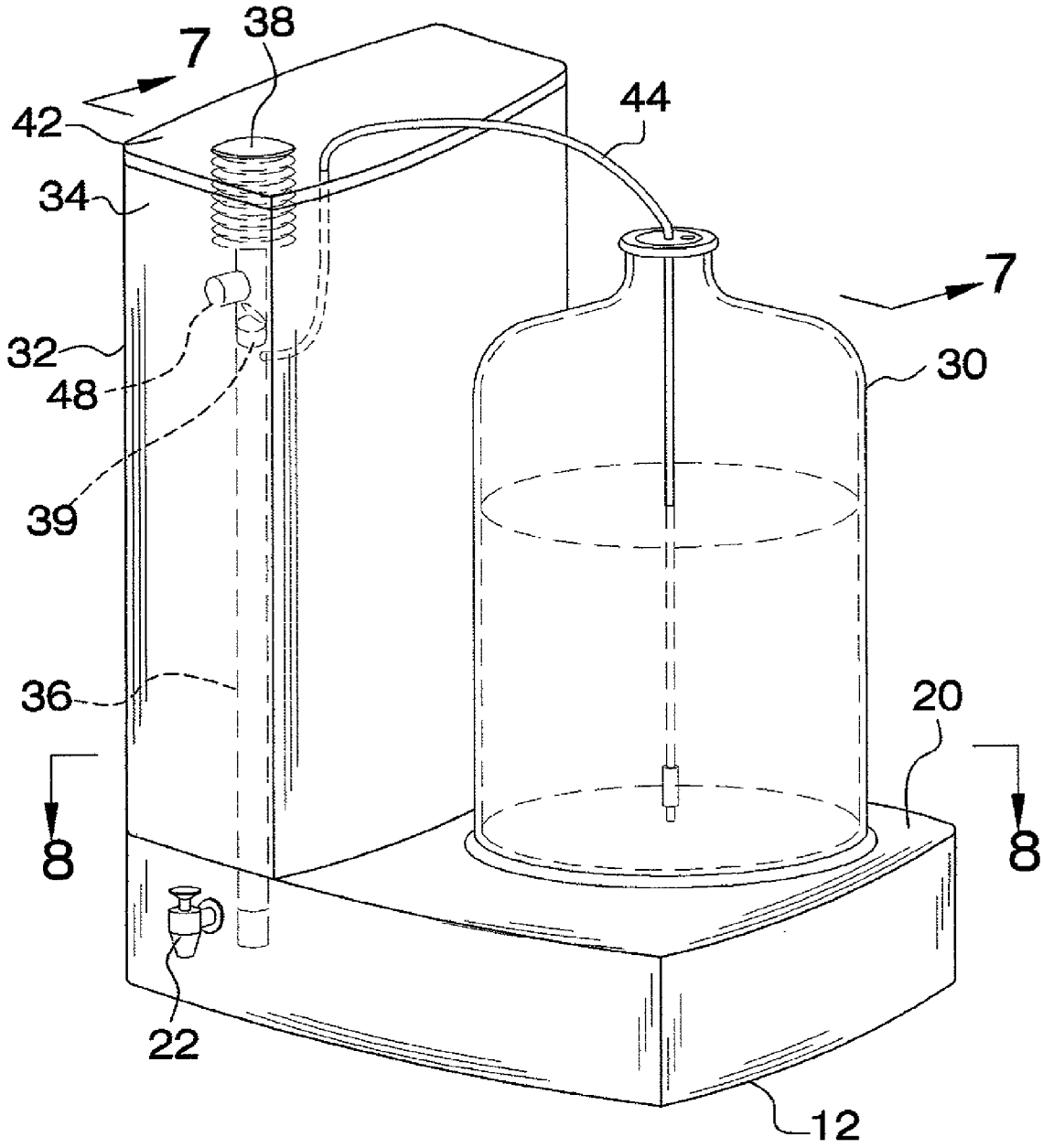
FIG. 6 is a perspective view of an embodiment of the base and exterior tube of the present invention showing.
Figure 7:
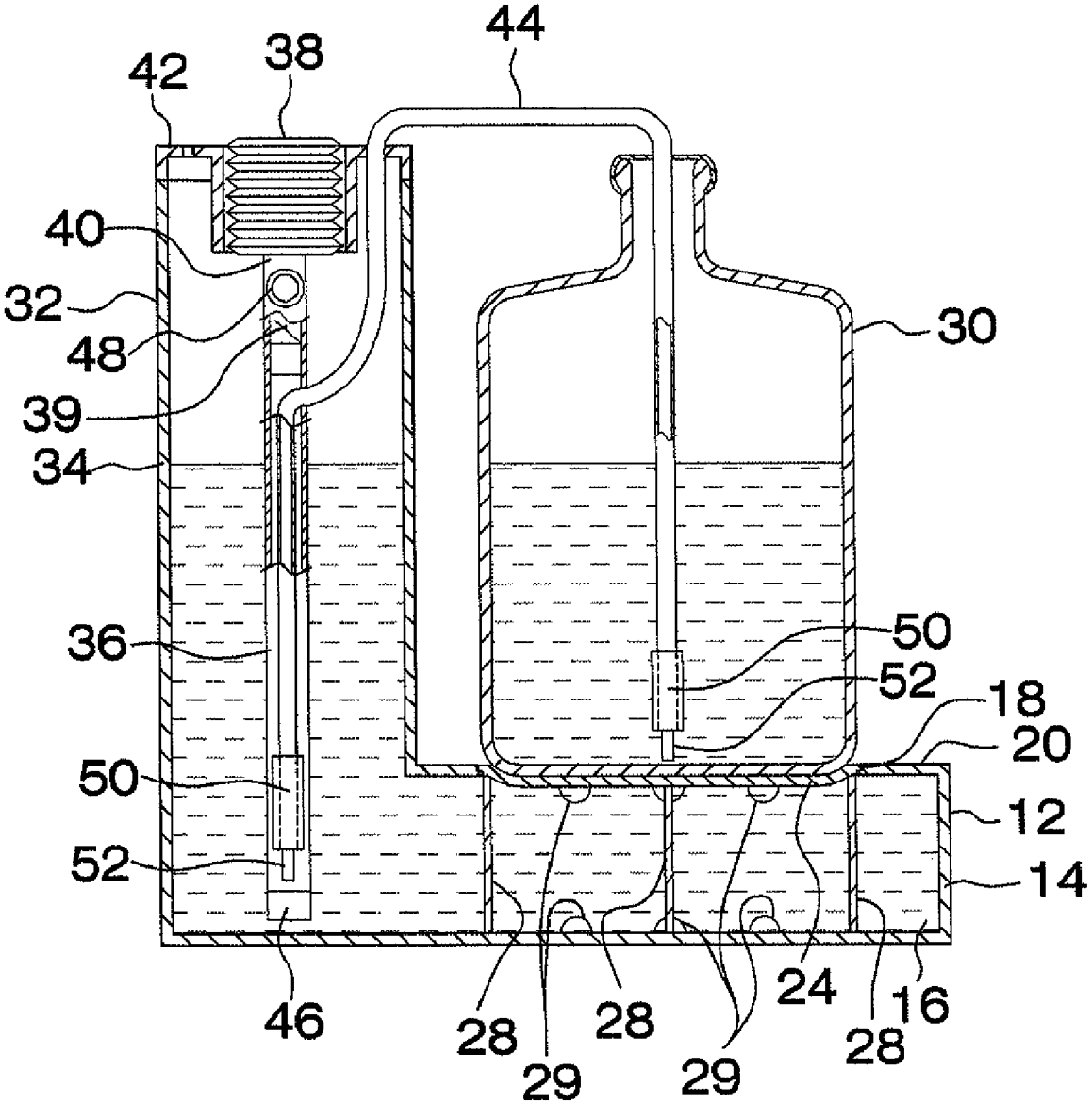
FIG. 7 is a cross-sectional view of the present invention taken along line 7-7 of FIG. 6.
Figure 8:
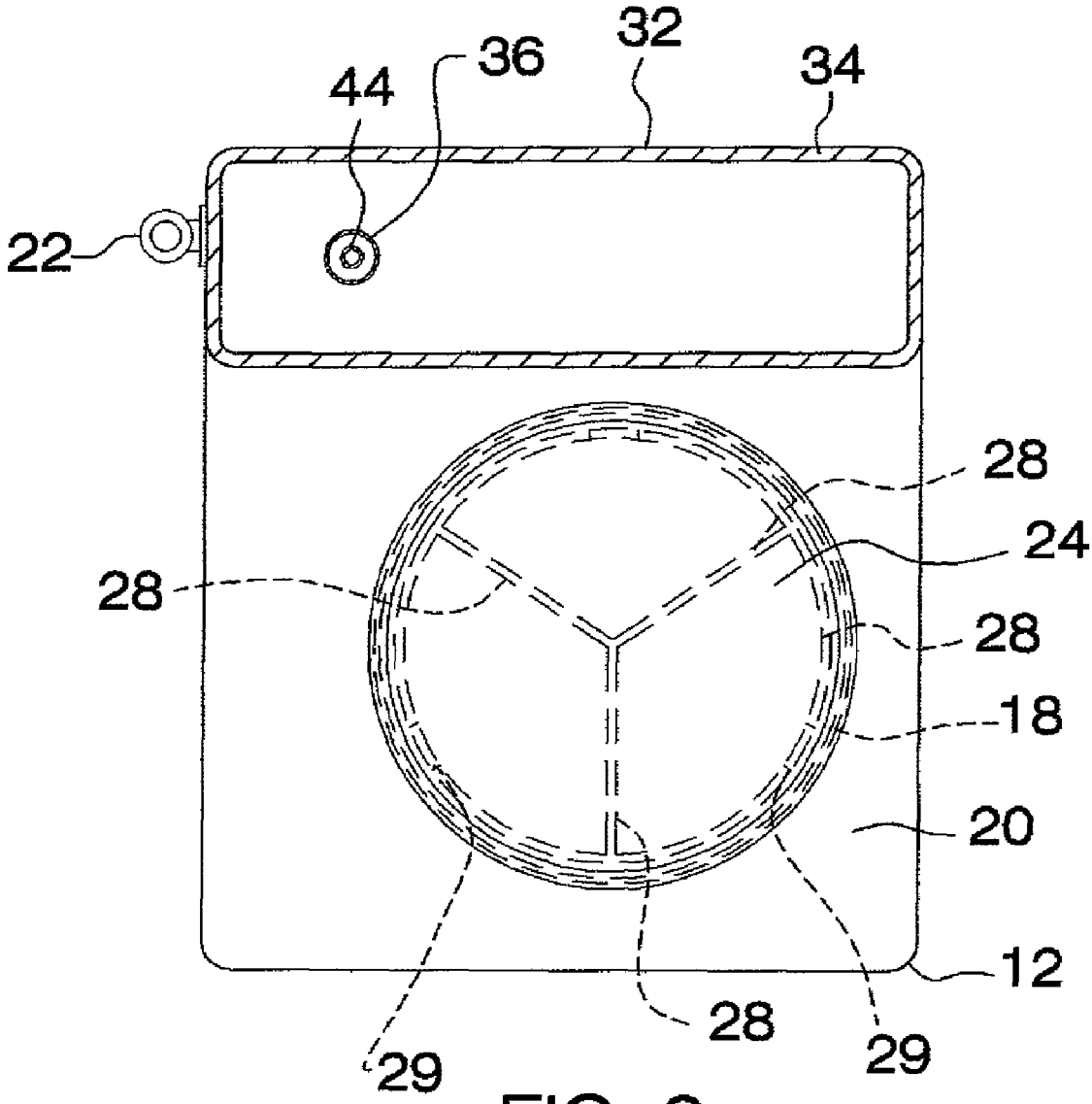
FIG. 8 is a cross-sectional view of the present invention taken along line 8-8 of FIG. 6.

With reference now to the drawings, and in particular to FIGS. 1 through 8 thereof, a new bottled water transfer device embodying the principles and concepts of the present invention and generally designated by the reference numeral 10 will be described.

As best illustrated in FIGS. 1 through 8, the liquid dispensing system 10 generally comprises a base 12 being positionable on a support surface. The base 12 includes a perimeter wall 14 defining an interior space 16 of the base 12. The interior space 16 receives and stores a liquid to be dispensed. The base 12 has an access aperture 18 extending through a top surface 20 of the base 12 and into the interior space 16 of the base 12. The access aperture 18 permits access to said interior space 16 of the base 12 when the interior space 16 of the base 12 is to be cleaned. A spigot 22 is coupled to the perimeter wall 14 and in fluid communication with the interior space 16.

A closure lid 24 is couplable to the base 12 and positioned in the access aperture 18 to selectively close the access aperture 18. The closure lid 24 includes a concave upper surface 26. A seal 27 is positioned between the closure lid 24 and the base 12 to inhibit the liquid passing between the closure lid 24 and the base 12. A plurality of support walls 28 is coupled to the perimeter wall 14 of the base 12 and positioned in the interior space 16. The support walls 28 engage the closure lid 24 when the closure lid 24 is coupled to the base 12. A container 30 is positioned on the base 12. The container 30 contains the liquid to be supplied to the interior space 16 of the base 12. The container 30 is positioned on the concave upper surface 26 of the closure lid 24 to inhibit the container 30 sliding off of the base 12. A weight of the container 30 and the liquid in the container 30 are supported by the support walls 28 when the container 30 is positioned on the closure lid 24. Each of the support walls 28 has at least one cutout 29 extending therethrough. The at least one cutout 29 permits liquid in the interior space 16 to flow through the associated one of the support walls 28.

A pump assembly 32 is coupled to the base 12 and in fluid communication with the container 30 and the interior space 16 of the base 12. The pump assembly 32 is actuated to transfer liquid from the container 30 and into the interior space 16 of the base 12. The pump assembly 32 includes an exterior tube 34 coupled to the base 12 and extending upwardly from the base 12. The exterior tube 34 is in fluid communication with the interior space 16 of the base 12. An interior tube 36 is positioned in the exterior tube 34 and is in fluid communication with the interior space 16 of the base 12.

The pump assembly 32 also includes a pump 38 coupled to an upper end 40 of the interior tube 36 and positioned opposite the base 12. The pump 38 is positioned adjacent a top end 42 of the exterior tube 34 to permit actuation of the pump 38. The pump 38 creates a vacuum in the interior tube 36. A vacuum valve 39 is positioned in the interior tube 36. The vacuum valve 39 permits air in a portion of the interior tube 36 below the vacuum valve 39 to pass through the vacuum valve 39 to a portion of the interior tube 36 above the vacuum valve 39 when the pump 38 is actuated. The vacuum valve 39 inhibits air in the interior tube 36 above the vacuum valve 39 from passing through the vacuum valve 39.

The pump assembly 32 additionally includes a supply tube 44 coupled to and extending into the interior tube 36. The supply tube 44 is in fluid communication with the container 30. The liquid in the container 30 is drawn through the supply tube 44 and into the interior tube 36 due to a siphoning effect created when the pump 38 is actuated to create a vacuum in the interior tube 36. A discharge valve 46 is coupled to the interior tube 36 opposite the pump 38. The discharge valve 46 opens to permit fluid in the interior tube 36 to enter the interior space 16 of the base 12 when a pressure from the liquid in the interior tube 36 is greater than a pressure outside of the interior tube 36. An overflow valve 48 is coupled to the interior tube 36 adjacent the top end 42 of the exterior tube 34. The overflow valve 48 opening permits liquid in the interior tube 36 to drain into the exterior tube 34 when the liquid has reached the over flow valve.

The supply tube 44 includes a pair of enlarged sections 50. Each of a pair of terminal ends 52 of the supply tube has one of the enlarged sections 50 positioned adjacent thereto. Each of the enlarged sections 50 holds a volume of liquid greater than a similar length of said supply tube 44. The weight and pressure of the liquid of each of the enlarged sections 50 acting on the associated one of the terminals ends 52 inhibits air entering into the supply tube through the terminal ends 52. The enlarged section 50 positioned in the pump assembly 32 holds a greater volume of liquid than the enlarged section 50 positioned in the container 30. Due to the siphoning of the liquid from the container the weight of the liquid in the enlarged section 50 in the pump assembly 32 provides additional siphoning action to the liquid in the container 30 to increase the ability to draw the liquid out of the container 30 to a level of terminal end 52 positioned in the container 30.

In use, the container 30 is placed on the base 12 and the supply tube 44 is inserted into the liquid in the container 30. The pump 38 of the pump assembly 32 is then actuated to create a vacuum in the interior tube 36. The vacuum in the interior tube 36 induces a siphoning effect in the supply tube 44 to draw liquid through the supply tube 44 and into the interior tube 36. The spigot 22 is then actuated to dispense the liquid from the interior space 16 of the base 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid dispensing system for dispensing a liquid, said system comprising:

a base being positionable on a support surface, said base including a perimeter wall defining an interior space of said base, said interior space receiving and storing the liquid to be dispensed;

a spigot being coupled to said perimeter wall and in fluid communication with said interior space;

a container being positioned on said base, said container containing the liquid to be supplied to said interior space of said base; and a pump assembly being coupled to said base and in fluid communication with said container and said interior space of said base, said pump assembly being actuated to transfer liquid from said container and into said interior space of said base, said pump assembly including;

an exterior tube being coupled to said base and extending upwardly from said base, said exterior tube being in fluid communication with said interior space of said base;

an interior tube being positioned in said exterior tube and being in fluid communication with said interior space of said base a pump being coupled to an upper end of said interior tube and positioned opposite said base, said pump being positioned adjacent a top end of said exterior tube to permit actuation of said pump, said pump creating a vacuum in said interior tube; and a supply tube being coupled to and extending into said interior tube, said supply tube being in fluid communication with said container, the liquid in said container being drawn through said supply tube and into said interior tube when said pump is actuated to create a vacuum in said interior tube.

2. The system according to claim 1, wherein said base has an access aperture extending through a top surface of said base and into said interior space of said base.

3. The system according to claim 2, further comprising a closure lid being couplable to said base and positioned in said access aperture to selectively close said access aperture.

4. The system according to claim 3, wherein said closure lid includes a concave upper surface, said container being positioned on said concave upper surface of said closure lid to inhibit said container sliding off of said base.

5. The system according to claim 3, further comprising a plurality of support walls being coupled to said perimeter wall of said base and positioned in said interior space, said support walls engaging said closure lid when said closure lid is coupled to said base.

6. The system according to claim 5, wherein each of said support walls has at least one cutout extending therethrough, said at least one cutout permitting liquid in said interior space to flow through the associated one of said support walls.

7. The system according to claim 1, wherein said pump assembly includes a vacuum valve being positioned in said interior tube, said vacuum valve permitting air in a portion of said interior tube below said vacuum valve to pass through said vacuum valve to a portion of said interior tube above said vacuum valve when said pump is actuated, said vacuum valve inhibiting air in said interior tube above said vacuum valve from passing through said vacuum valve.

8. The system according to claim 1, wherein said supply tube includes a pair of enlarged sections, each of a pair of terminal ends of said supply tube has one of said enlarged sections positioned adjacent thereto, each of said enlarged sections holds a volume of liquid greater than a similar length of said supply tube.

9. The system according to claim 8, wherein said enlarged section positioned in said pump assembly holds a greater volume of liquid than said enlarged section positioned in said container.

10. A liquid dispensing system for dispensing a liquid, said system comprising:

a base being positionable on a support surface, said base including a perimeter wall defining an interior space of said base, said interior space receiving and storing the liquid to be dispensed, said base having an access aperture extending through a top surface of said base and into said interior space of said base;

a spigot being coupled to said perimeter wall and in fluid communication with said interior space;

a closure lid being couplable to said base and positioned in said access aperture to selectively close said access aperture, said closure lid including a concave upper surface;

a plurality of support walls being coupled to said perimeter wall of said base and positioned in said interior space, said support walls engaging said closure lid when said closure lid is coupled to said base, each of said support walls has at least one cutout extending therethrough, said at least one cutout permitting liquid in said interior space to flow through the associated one of said support walls;

a container being positioned on said base, said container containing the liquid to be supplied to said interior space of said base, said container being positioned on said concave upper surface of said closure lid to inhibit said container sliding off of said base;

a pump assembly being coupled to said base and in fluid communication with said container and said interior space of said base, said pump assembly being actuated to transfer liquid from said container and into said interior space of said base, said pump assembly comprising;

an exterior tube being coupled to said base and extending upwardly from said base, said exterior tube being in fluid communication with said interior space of said base;

an interior tube being positioned in said exterior tube and being in fluid communication with said interior space of said base;

a pump being coupled to an upper end of said interior tube and positioned opposite said base, said pump being positioned adjacent a top end of said exterior tube to permit actuation of said pump, said pump creating a vacuum in said interior tube;

a vacuum valve being positioned in said interior tube, said vacuum valve permitting air in a portion of said interior tube below said vacuum valve to pass through said vacuum valve to a portion of said interior tube above said vacuum valve when said pump is actuated, said vacuum valve inhibiting air in said interior tube above said vacuum valve from passing through said vacuum valve; and a supply tube being coupled to and extending into said interior tube, said supply tube being in fluid communication with said container, the liquid in said container being drawn through said supply tube and into said interior tube when said pump is actuated to create a vacuum in said interior tube, said supply tube includes a pair of enlarged sections, each of a pair of terminal ends of said supply tube has one of said enlarged sections positioned adjacent thereto, each of said enlarged sections holds a volume of liquid greater than a similar length of said supply tube, said enlarged section positioned in said pump assembly holds a greater volume of liquid than said enlarged section positioned in said container.

* * * * *